US006474843B2

(12) United States Patent
Shieh

(10) Patent No.: US 6,474,843 B2
(45) Date of Patent: Nov. 5, 2002

(54) GLOBULAR DECORATIVE LIGHT ASSEMBLY WITH FLEXIBLE SUPPORTING FRAME

(76) Inventor: Whiter Shieh, 6F, No. 245, Tun Hua South Road, Sec. 1, Taipei, 106 (TW)

( * ) Notice: Subject to any disclaimer, the term of this patent is extended or adjusted under 35 U.S.C. 154(b) by 52 days.

(21) Appl. No.: 09/824,026

(22) Filed: Apr. 3, 2001

(65) Prior Publication Data

US 2002/0141184 A1 Oct. 3, 2002

(51) Int. Cl.[7] ..... F21S 13/14

(52) U.S. Cl. ..... 362/252; 362/250; 362/252; 362/227; 362/806; 362/809

(58) Field of Search ..... 362/363, 238, 362/239, 250, 249, 227, 252, 806, 809, 352, 450, 453, 454, 407, 408

(56) References Cited

U.S. PATENT DOCUMENTS 1,271,091 A * 7/1918 Sito ..... 362/352
2,731,752 A * 1/1956 Erickson et al. ..... 362/123
3,162,377 A * 12/1964 Ozeki ..... 362/320
4,061,913 A * 12/1977 Ross ..... 362/357
4,654,767 A * 3/1987 Yamaguchi ..... 362/352
5,629,057 A * 5/1997 Wang et al. ..... 428/9
5,645,343 A * 7/1997 Rinehimer ..... 362/252
6,070,991 A * 6/2000 Rumpel ..... 362/249
6,401,404 B1 * 6/2002 Fillipp et al. ..... 52/80.1
6,419,373 B1 * 7/2002 Shieh ..... 362/249

* cited by examiner

*Primary Examiner*—Alan Cariaso
*Assistant Examiner*—Sharon Payne
(74) *Attorney, Agent, or Firm*—Rosenberg, Klein & Lee

(57) ABSTRACT

A globular decorative light assembly with a flexible supporting frame is disclosed. The flexible supporting frame includes a top fixed ring provided with a central hole, a bottom fixed ring arranged corresponding to the top fixed ring, a central pulling rope, and a plurality of flexible supporting sticks. Each of the flexible supporting sticks is pivotally arranged around the top fixed ring, while the bottom end of each flexible supporting sticks is pivotally arranged around the bottom fixed ring, thereby forming the flexible supporting frame for the globular decorative light assembly. The flexible supporting frame may be unfolded or folded by means of operating the central pulling rope. A net is covered on the flexible supporting frame, and the net may further incorporate with a plurality of light units arranged thereon for decoration.

8 Claims, 9 Drawing Sheets

GLOBULAR DECORATIVE LIGHT ASSEMBLY WITH FLEXIBLE SUPPORTING FRAME

BACKGROUND OF THE INVENTION

1. Field of the Invention

The present invention generally relates to a decorative light assembly, and in particular to a globular decorative light with a flexible supporting frame.

2. Description of the Prior Art

Decorative light strings are widely used in holidays and festivals. Conventionally, the decorative light string is arranged on a tree directly and randomly. For more versatile decorating purposes, various decorative light assemblies are developed in prior art. Globular decorative light assembly is one of the most popular decorative light products available in the market.

The conventional globular decorative light assembly mainly includes a number of light bulb holders mounted on a fixed supporting frame. However, because most of the prior art globular decorative light assemblies can't be folded, a larger storing and shipping space may be needed.

Thus, it is desirable to provide a globular decorative light assembly with a flexible supporting frame, which is easy to be conveniently folded and stored.

SUMMARY OF THE INVENTION

Accordingly, the primary object of the present invention is to provide a foldable globular decorative light assembly, which can be folded and unfolded very easily.

Another object of the present invention is to provide a flexible supporting frame for a globular decorative light assembly. Without any rigid central supporting posts, the globular decorative light assembly can be constructed by the flexible supporting frame.

To achieve the. objects above, the flexible supporting frame in accordance with a preferable embodiment of the present invention includes a top fixed ring provided with a central hole; a bottom fixed ring arranged corresponding. to the top fixed ring; and a central pulling rope having a top free end and a bottom end, the bottom end of which passing through the central hole of the top fixed ring and then fixed on the bottom fixed ring; and a plurality of flexible supporting sticks. Each of the flexible supporting sticks is pivotally arranged around the top fixed ring, while the bottom end of which is pivotally arranged around the bottom fixed ring, thereby forming a flexible supporting frame for the globular decorative light assembly. Preferably, a net is covered on the flexible supporting frame, and the net may further incorporate with a plurality of light units arranged thereon for decoration.

The present invention will be apparent to those skilled in the art by reading the following description of preferred embodiments thereof, with reference to the accompanying drawings, in which:

DETAILED DESCRIPTION OF THE PREFERRED EMBODIMENTS

Figure 1:
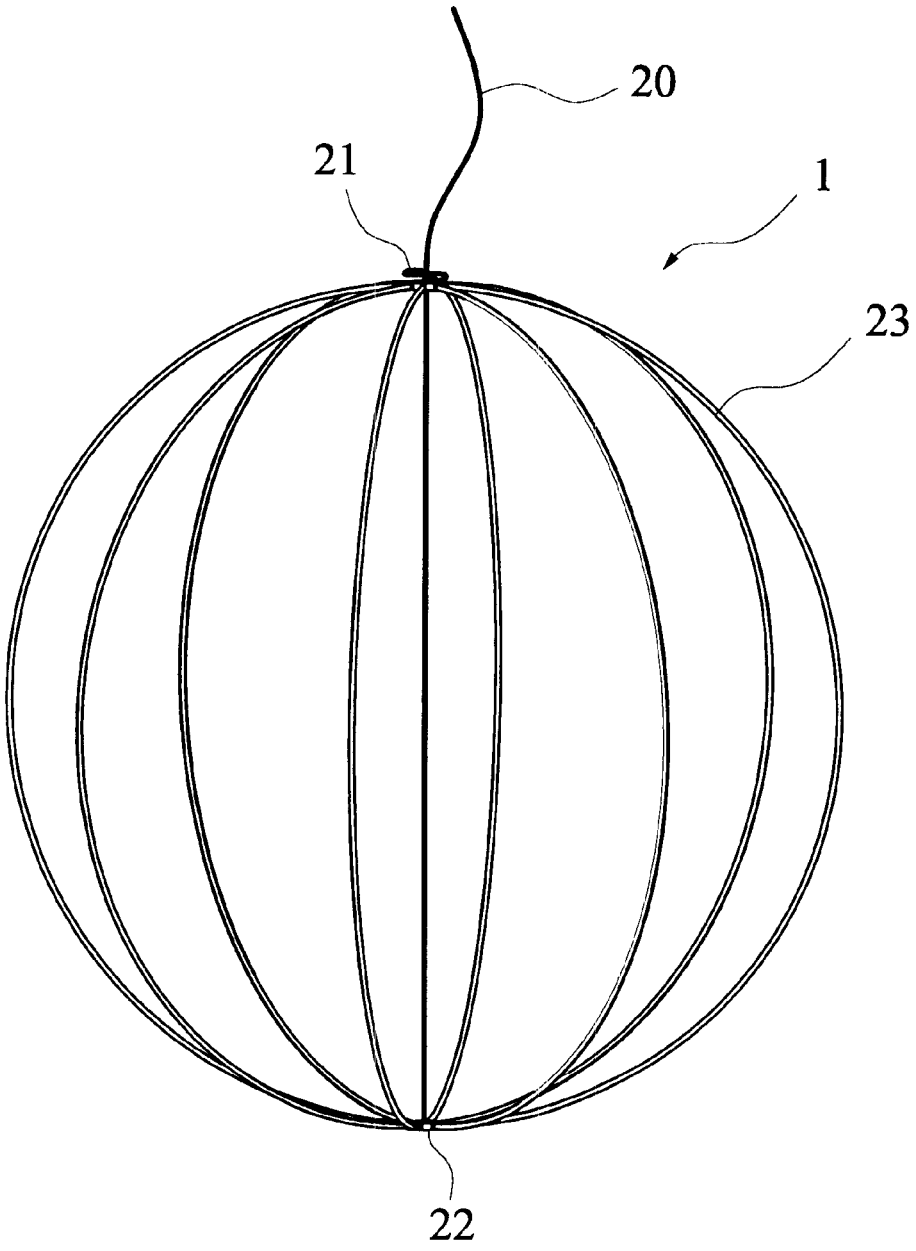
FIG. 1 is a perspective view of the flexible supporting frame in accordance with a first embodiment of the present invention.

With reference to FIG. 1, it shows a perspective view of the globular decorative light assembly in accordance with a first embodiment of the present invention. The globular decorative light assembly 1 of the present invention includes a central pulling rope 20, a top fixed ring 21, a bottom fixed ring 22, a plurality of flexible supporting sticks 23, and a net 24. The top fixed ring 21, the bottom fixed ring 22, and the flexible supporting sticks are constructed to form a supporting frame for the globular decorative light assembly of the present invention. The top end of each flexible supporting sticks 23 is pivotally arranged around the top fixed ring 21, while the bottom end of each flexible supporting sticks 23 is pivotally arranged around the bottom fixed ring 22.

Figure 2:
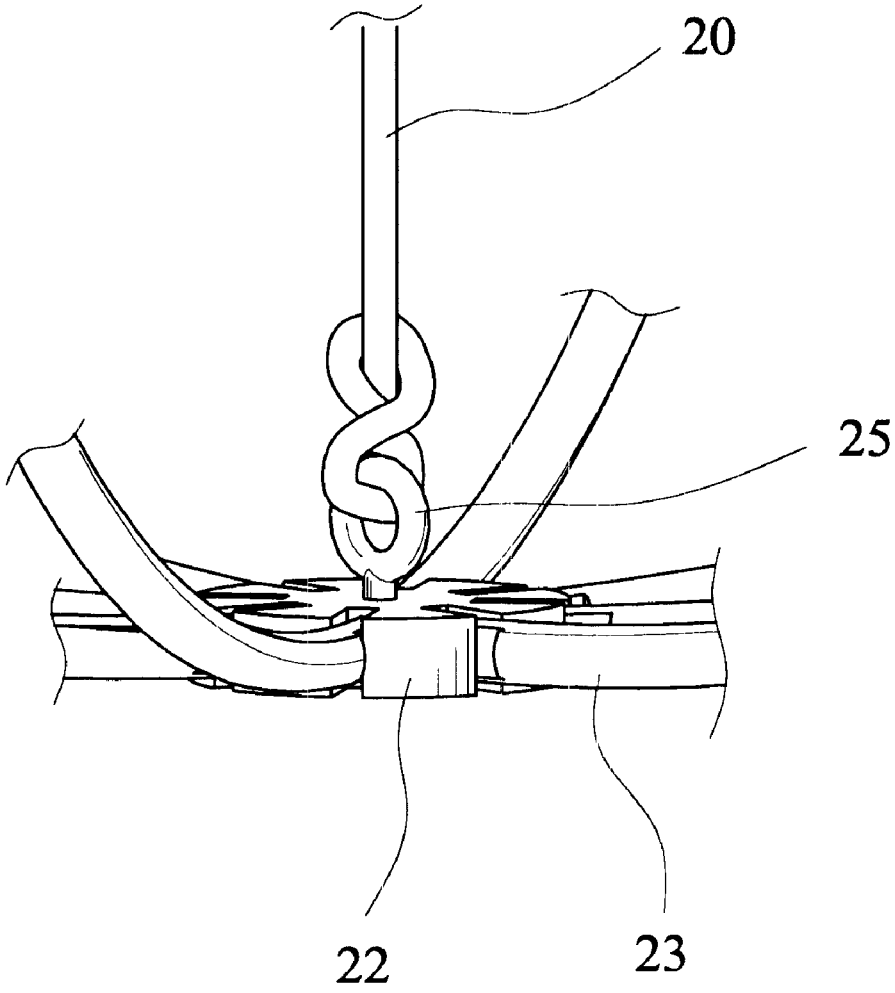
FIG. 2 is an enlarged perspective view showing a constructing relationship among the bottom fixed ring, the central pulling rope and the supporting sticks of FIG. 1.

The central portion of the bottom fixed ring 22 may be provided with an upward buckle 25, so that the bottom end of the central pulling rope 20 may be tied in the buckle 25, as shown in FIG. 2. The top end of the central pulling rope 20 passes through a central hole 26 formed on the center of the top fixed ring 21, as shown in FIG. 3.

In operation, the user can unfold the decorative light assembly of the present invention by simply holding the top fixed ring 21 by one hand and simultaneously pulling the central pulling rope 20 by the other hand. At this time, a pulling force is applied to the bottom fixed ring 22, causing each of the flexible supporting sticks 23 to be concurrently bent outwardly at its central section, and thereby constructing a globular supporting frame, as shown in FIG. 1.

Figure 4:
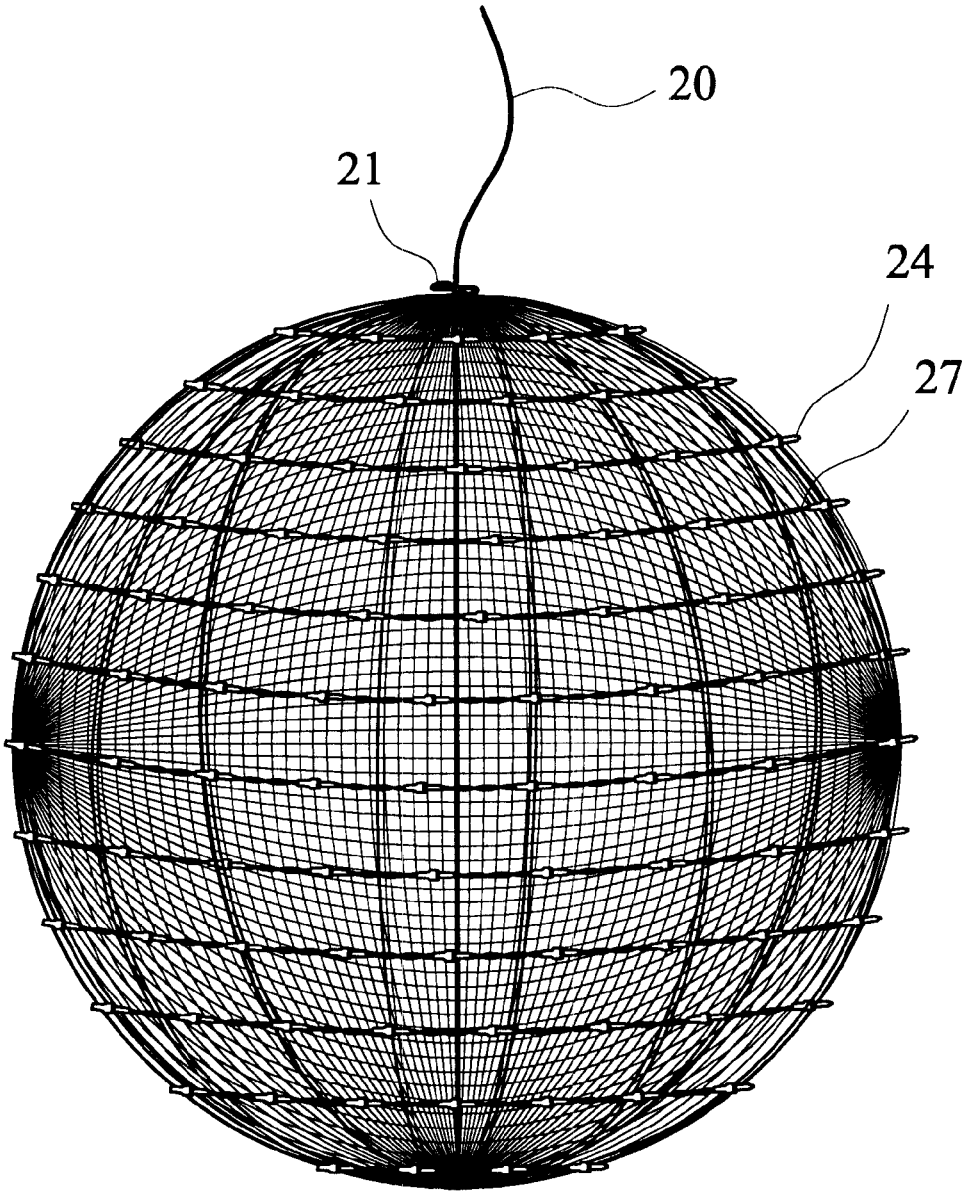
FIG. 4 is a perspective view showing that a net is further covered on the flexible supporting frame of FIG. 1.

With reference to FIG. 4, there is shown that a net 24 is further covered on the supporting frame of the present invention. The net 24 may be made by meshed wire or meshed plastic material. For more versatile decorating purposes, the net 24 is preferably incorporated with a number of light units 24 electrically connected in series by electric wires 27.

Figure 3:
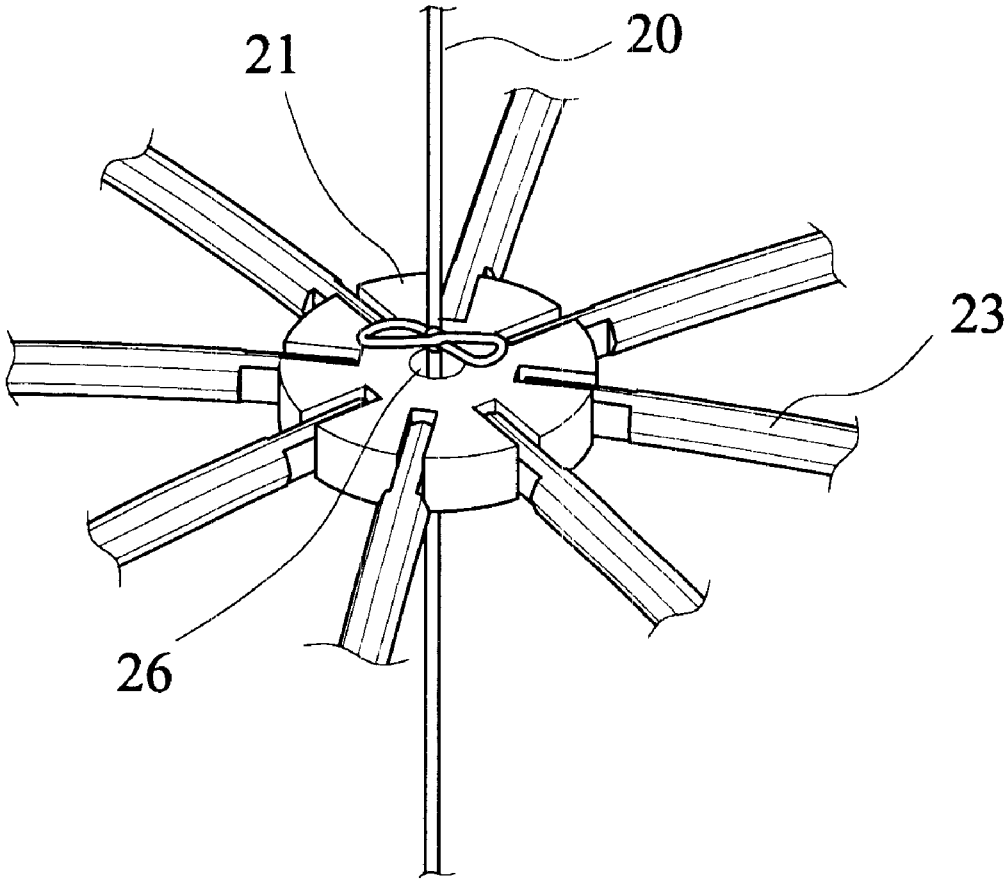
FIG. 3 is an enlarged perspective view showing the constructing relationship among the top fixed ring, the central pulling rope and the supporting sticks of FIG. 1.

To steadily retain the supporting frame of the present invention in a globular configuration, a simple knot may be tied on the central pulling rope 20, as shown in FIG. 3.

Figure 5:
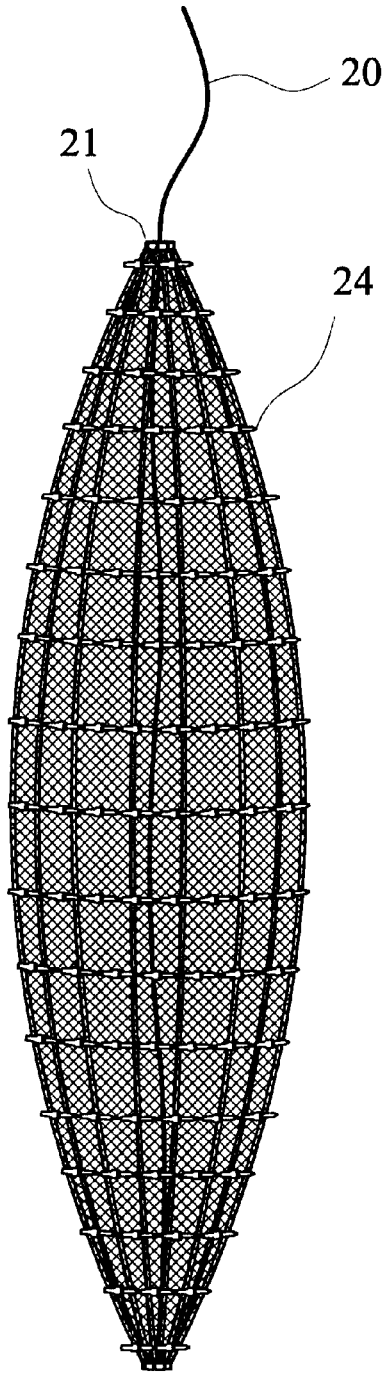
FIG. 5 is a perspective view of the flexible supporting frame of the present invention after folding.
Figure 6:
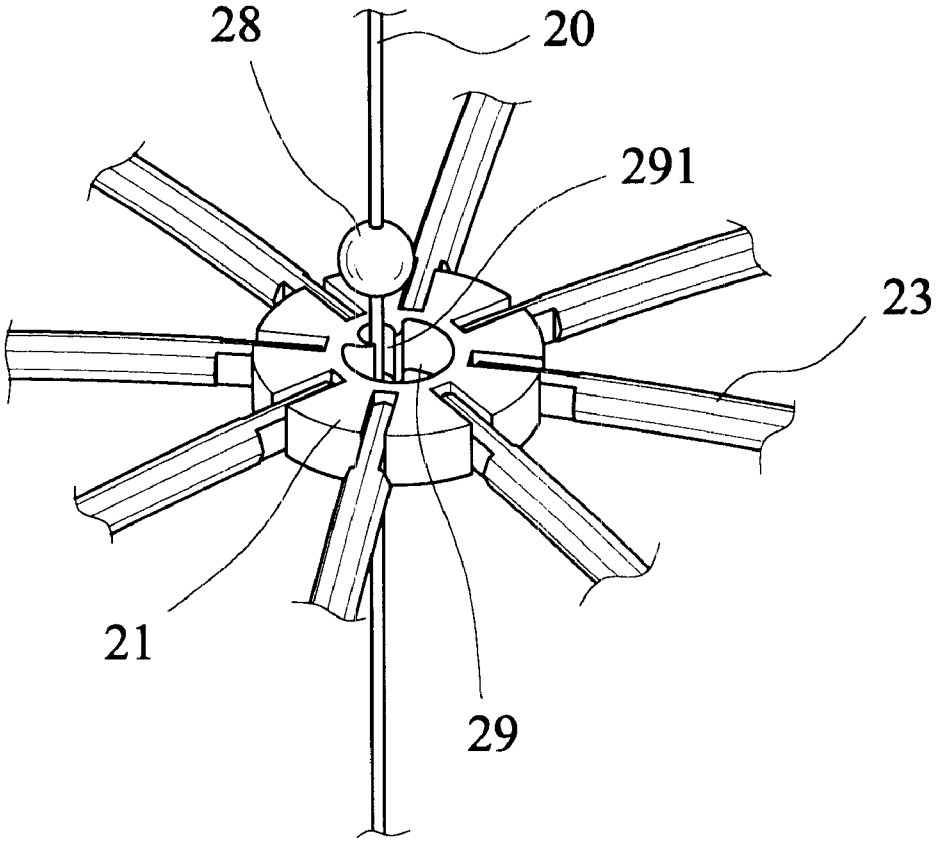
FIG. 6 is a perspective view showing a bead is further mounted on the central pulling rope of FIG. 3.

The user can fold the decorative light assembly of the present invention by simply releasing the knot from the central hole 26 of the central pulling rope 20. FIG. 5 shows a perspective view of the decorative light assembly of the present invention after folding.

Figure 7:
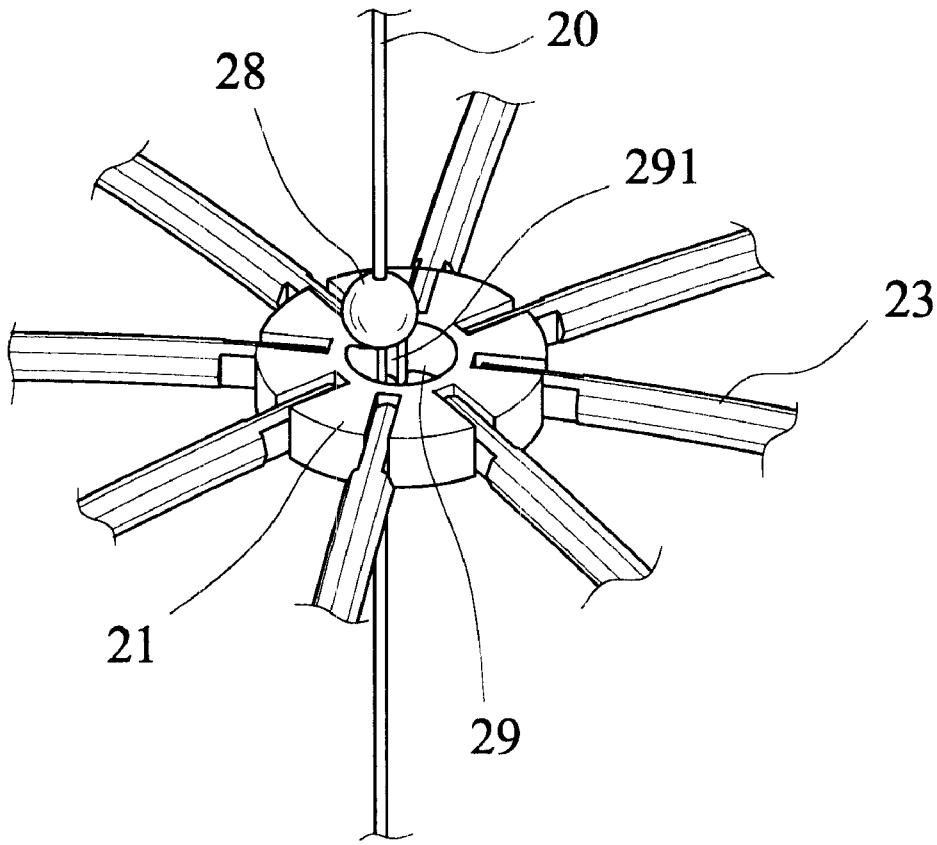
FIG. 7 is a perspective view showing the bead of FIG. 6 is blocked on the top fixed ring of the present invention.
Figure 8:
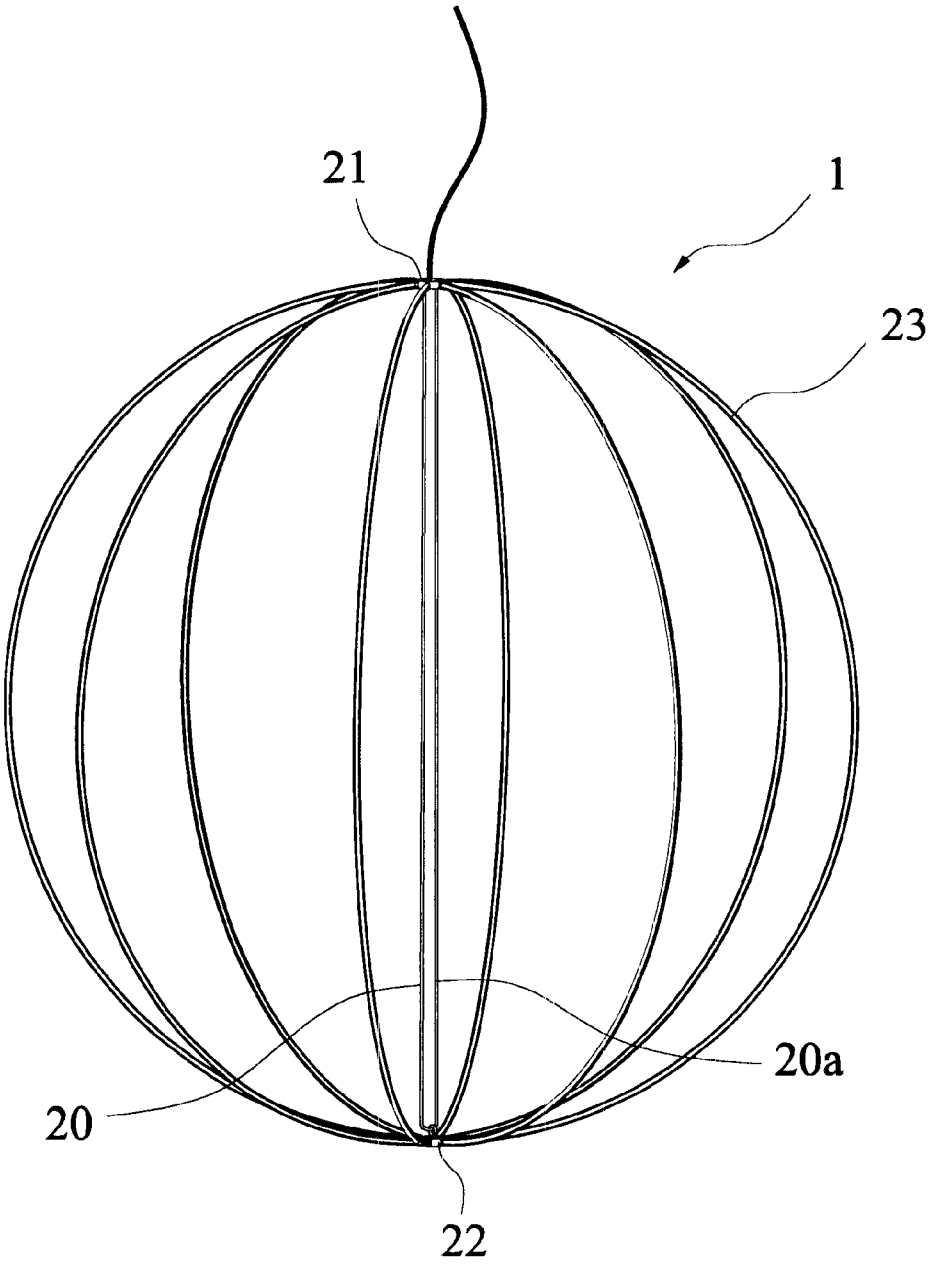
FIG. 8 is a perspective view of the flexible supporting frame in accordance with a second embodiment of the present invention.

Alternatively, a bead 28 may be mounted or clipped on the central pulling rope 20, with reference to FIGS. 7 and 8, to facilitate the folding/unfolding operation of the present invention. In this embodiment, a C-shape clip 291 is further formed on an inner side wall of an enlarged central hole 29 of the top fixed ring 21. The bead 28 together with the rope 20 may freely pass through the enlarged central hole 2, but the bead 28 can not pass through the C-shape clip 291. Therefore, the bead 28 serves as a stopper having a blocked function same as the function of the knot described above, capable of steadily retaining the supporting frame in a globular manner when it is blocked on the C-shape clip 291.

With reference to FIG. 8, it shows a perspective view of the globular decorative light assembly in accordance with a second embodiment of the present invention. The globular decorative light assembly 1 of this embodiment also includes a central pulling rope 20, a top fixed ring 21, a bottom fixed ring 22, a plurality of flexible supporting sticks 23. So, the same reference numbers used in the previous embodiment will be used to refer to the same or like parts.

Figure 9:
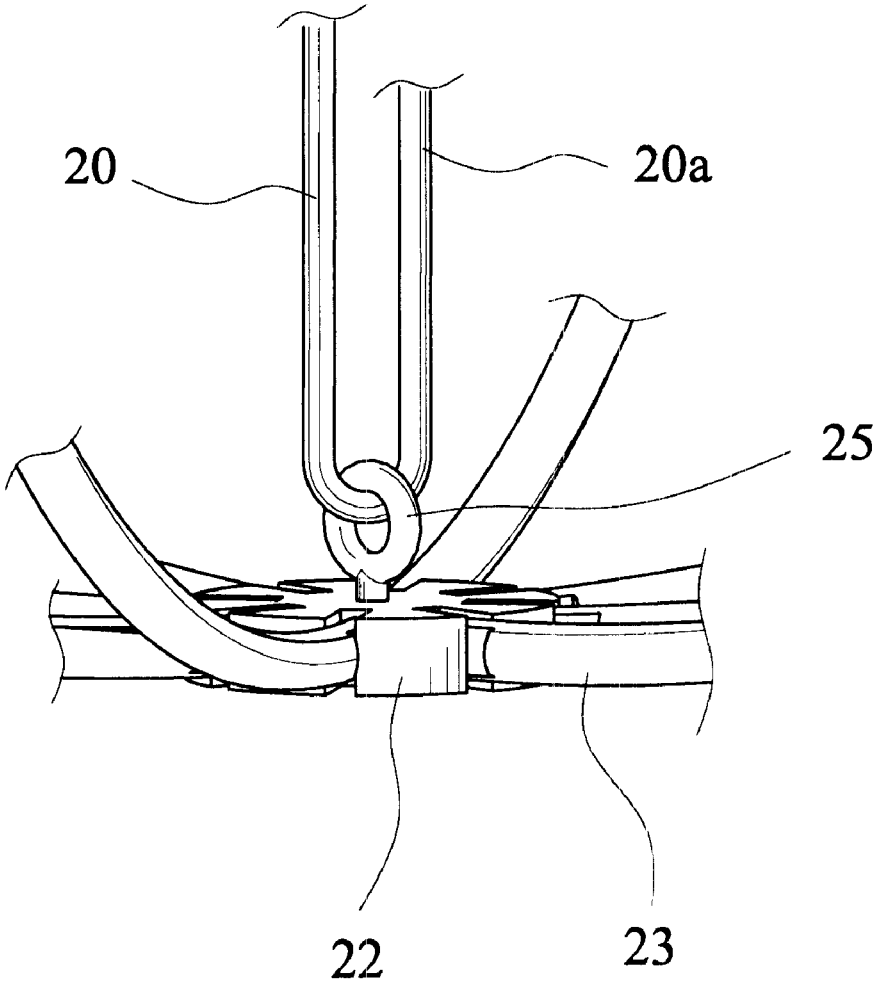
FIG. 9 is an enlarged perspective view showing a constructing relationship among the bottom fixed ring, the central pulling rope and the supporting sticks of FIG. 8.

The difference between this embodiment and the previous embodiment is that the lower end of the central pulling rope 20 first passes through the upward buckle 25 formed on the central portion of the bottom fixed ring 22. Then, an extended section 20*a* of the rope 20 returns backward to the top fixed ring 21, and finally the lower end of the central pulling rope 20 is fixed on the top fixed ring 21, with reference to FIGS. 8 and 9.

In operation, the user can unfold the decorative light assembly of the present invention by simply holding the top fixed ring 21 by one hand and simultaneously pulling the central pulling rope 20 by the other hand. At this time, a pulling force is applied between the top fixed ring 21 and the bottom fixed ring 22 by means of the central pulling rope 20 and the extended section 20*a* of the rope 20, causing each of the flexible supporting sticks 23 to be concurrently bent outwardly at its central section, and thereby constructing a globular supporting frame, as shown in FIG. 1. To retain the supporting frame of the present invention in a globular configuration, a simple knot same as the previous embodiment may be tied on the central pulling rope.

While the present invention has been described with reference to the specific embodiments, the description is illustrative of the invention and is not to be construed as limiting the invention. Therefore, various modifications to the present invention can be made to the preferred embodiments by those skilled in the art without departing from the true spirit and scope of the invention as defined by the appended claims.

What is claimed is:

1. A globular decorative light assembly comprising:

a top fixed ring provided with a central hole;

a bottom fixed ring arranged corresponding to the top fixed ring;

a central pulling rope having a top free end and a bottom end, the bottom end of which passing through the central hole of the top fixed ring and then fixed on the bottom fixed ring; and a plurality of flexible supporting sticks, each of which being pivotally arranged around the top fixed ring, while the bottom end of each flexible supporting sticks being pivotally arranged around the bottom fixed ring, thereby forming a flexible supporting frame for the globular decorative light assembly.

2. The globular decorative light assembly as claimed in claim 1, further comprising a net covered on the flexible supporting frame.

3. The globular decorative light assembly as claimed in claim 2, the net further incorporating with a plurality of light units arranged thereon.

4. The globular decorative light assembly as claimed in claim 1, wherein the central pulling rope is provided with a bead, and a C-shape clip is further formed on an inner side wall of the central hole of the top fixed ring.

5. A globular decorative light assembly comprising:

a top fixed ring provided with a central hole;

a bottom fixed ring arranged corresponding to the top fixed ring, the bottom fixed ring being provided with a buckle thereon;

a central pulling rope having a top free end and a bottom end, the bottom end of which passing through the central hole of the top fixed ring and the buckle formed on the bottom fixed ring in sequence, and then fixed on the top fixed ring; and a plurality of flexible supporting sticks, each of which being pivotally arranged around the top fixed ring, while the bottom end of each flexible supporting sticks being pivotally arranged around the bottom fixed ring, thereby forming a flexible supporting frame for the globular decorative light assembly.

6. The globular decorative light assembly as claimed in claim 5, further comprising a net covered on the flexible supporting frame.

7. The globular decorative light assembly as claimed in claim 6, the net further incorporating with a plurality of light units arranged thereon.

8. The globular decorative light assembly as claimed in claim 5, wherein the central pulling rope is provided with a bead, and a C-shape clip is further formed on an inner side wall of the central hole of the top fixed ring.

* * * * *